US006309063B1

(12) United States Patent
Kamano et al.

(10) Patent No.: US 6,309,063 B1
(45) Date of Patent: Oct. 30, 2001

(54) INK-JET PRINTER

(75) Inventors: Tadao Kamano, Shizuoka-ken; Hiroyuki Takada, Mishima; Shigeru Morino, Numazu; Hitoshi Ushiogi, Mishima; Kyouichi Shibata, Mishima; Takashi Kashiwagi, Mishima; Izumi Araki, Mishima; Hiroshi Yamaguchi; Hidenobu Suzuki, both of Numazu; Hiroaki Watanabe, Tanashi, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/132,926

(22) Filed: Aug. 12, 1998

Related U.S. Application Data

(63) Continuation of application No. PCT/JP97/04689, filed on Dec. 18, 1997.

(30) Foreign Application Priority Data

| | | |
|---|---|---|
| Dec. 18, 1996 | (JP) | 8-337881 |
| Dec. 19, 1996 | (JP) | 8-340099 |
| Jan. 7, 1997 | (JP) | 9-000456 |
| Feb. 28, 1997 | (JP) | 9-045511 |

(51) Int. Cl.[7] ..... B41J 2/01
(52) U.S. Cl. ..... 347/104
(58) Field of Search ..... 347/104; 271/276, 271/311, 312; 400/692; 346/138; 397/305

(56) References Cited

U.S. PATENT DOCUMENTS

| | | | | |
|---|---|---|---|---|
| 4,062,534 | * | 12/1977 | Sasahara | 271/174 |
| 4,285,507 | * | 8/1981 | Marinof | 271/3 |
| 5,486,898 | * | 1/1996 | Fujii et al. | 355/200 |
| 5,771,054 | * | 6/1998 | Dudek et al. | 347/102 |

FOREIGN PATENT DOCUMENTS

| | | | |
|---|---|---|---|
| 62-94071 | | 4/1987 | (JP) . |
| 63-163354 | * | 6/1988 | (JP) . |
| 1-120375 | | 5/1989 | (JP) . |
| 1-133845 | | 5/1989 | (JP) . |
| 1-186363 | | 7/1989 | (JP) . |
| 2-11376 | | 1/1990 | (JP) . |
| 4-69272 | | 3/1992 | (JP) . |
| 7-152302 | | 6/1995 | (JP) . |
| 7-34451 | | 6/1995 | (JP) . |
| 8-225214 | | 9/1996 | (JP) . |
| WO 96 34762 A | | 11/1996 | (WO) . |

* cited by examiner

*Primary Examiner*—John Barlow
*Assistant Examiner*—Michael S. Brooke
(74) *Attorney, Agent, or Firm*—Frishauf, Holtz, Goodman, Langer & Chick, P.C.

(57) ABSTRACT

An ink-jet printer includes a sheet feed-in mechanism 60 for feeding a paper sheet, a rotary drum 10 having a peripheral surface 11 of a size larger than the paper sheet to be fed by the sheet feed-in mechanism 60, for rotating at a constant speed, a sheet holding system 20 for holding the paper sheet on the peripheral surface of the rotary drum, a print head 200 for printing an image by repeatedly ejecting ink onto the paper sheet held on the peripheral surface of the rotary drum 10 while the rotary drum 10 performs a predetermined number of rotations, a sheet separator 140 for separating the paper sheet from the peripheral surface 11 of the rotary drum, a sheet feed-out mechanism 160 for feeding out the paper sheet separated by the sheet separator 140, a control unit 111 for controlling the sheet feed-in mechanism 60, the rotary drum 10, the sheet holding system 20, the print head 200, the sheet separator 140 and the sheet feed-out mechanism 160. In particular, the control unit 111 is constructed such that the sheet holding system 20, the print head 200 and the sheet separator 140 are sequentially driven on the basis of the number of rotations of the rotary drum 10.

10 Claims, 12 Drawing Sheets

INK-JET PRINTER

CROSS-REFERENCE TO RELATED APPLICATIONS

This is a Continuation Application of International Application No. PCT/JP97/04689, filed Dec. 18, 1997, the entire contents of which are incorporated herein by reference.

BACKGROUND OF THE INVENTION

This invention relates to an ink-jet printer for ejecting ink onto a sheet of paper held on a rotary drum to perform printing.

Recently, personal computers of high performance and low cost have become available, and the spread of personal computers has abruptly increased. In accordance with this trend, color printers have been also increasingly demanded. At the present stage, various types of ink-jet printers exist as color printers suitable for personal use.

Conventionally, there is a known ink-jet printer which can perform a continuous printing of 500 or more sheets, for example. This ink-jet printer has a rotary drum which rotates at a predetermined circumferential speed, and a print head for ejecting color inks onto a sheet of paper held on the peripheral surface of the rotary drum. The sheet is fed to the rotary drum from the front side of the rotary drum, and printing is performed in a state where the paper sheet is wound on the rotary drum. After printing, the paper sheet is separated from the rotary drum and discharged to the rear side of the rotary drum.

The print head includes nozzle units of, for example, yellow, cyan, magenta and black which are disposed along the peripheral surface of the rotary drum. Each of the nozzle units has ink-jet nozzles which are arranged across the paper sheet in the main scanning direction parallel to the axis of the rotary drum and which eject inks as the rotary drum rotates. Each nozzle unit is shifted in the main scanning direction at a predetermined rate, and returned to its initial position after a predetermined number of rotations for causing the nozzle unit to be moved by a distance equal to the nozzle pitch. Each nozzle unit scans the paper sheet simultaneously in the main scanning direction and the sub-scanning direction as described above, so as to eject ink onto the entire paper sheet.

When the printing speed of the above ink-jet printer is increased, positional deviation or vibration of the paper sheet may occur due to an impact produced by the sheet holding operation. Further, positional deviation of the paper sheet may also occur due to an impact produced by the sheet separating operation. In such a case, incorrect alignment is caused between print dots of color inks and this significantly deteriorates the printing quality.

In addition, the rotary drum is surrounded by a variety of process components in the ink-jet printer described above. Therefore, it is not easy to carry out jam state work of removing a jammed paper sheet and maintenance work of removing paper particles dropped from a paper sheet and attached to the rotary drum. Furthermore, the jam state work or the maintenance work cannot be started while rotation of the rotary drum continues due to inertia. If such work is done irrespective of the rotation of the rotary drum, the operator may have his or her fingers injured as a result of being caught between the drum and the process components. These problems serve as a factor of substantially reducing the printing speed.

BRIEF SUMMARY OF THE INVENTION

An object of the present invention is to provide an ink-jet printer capable of improving the printing speed without deteriorating the printing quality.

According a first aspect of the present invention, there is provided an ink-jet printer which comprises a medium feed-in mechanism for feeding a print medium; a rotary drum having a peripheral surface of a size larger than the print medium fed by the medium feed-in mechanism, for rotating at a constant speed; a medium holding section for holding the print medium on the peripheral surface of the rotary drum; a print head for printing an image by repeatedly ejecting ink onto the print medium held on the peripheral surface of the rotary drum while the rotary drum performs a predetermined number of rotations; a medium separating section for separating the print medium from the peripheral surface of the rotary drum; a medium feed-out mechanism for feeding out the print medium separated by the medium separating section; and a control section for controlling the medium feed-in mechanism, the rotary drum, the medium holding section, the print head, the medium separating section and the medium feed-out mechanism; wherein the control section includes drive means for sequentially driving the medium holding section, the print head and the medium separating section on the basis of the number of rotations of the rotary drum.

According to a second aspect of the present invention, the ink-jet printer according to the first aspect further comprises a housing which houses the medium feed-in mechanism, the rotary drum, the medium holding section, the print head, the medium separating section, the medium feed-out mechanism and the control section, and a movable table capable of being moved into and out of the housing together with components of at least the rotary drum, the medium feed-in mechanism and the medium holding section in a state where the components are mounted on the movable table.

According to a third aspect of the present invention, the medium separating section of the ink-jet printer according to the first aspect includes a separating member for separating the print medium at a position which a leading end of the print medium reaches when an operation of the print head is completed.

According to a fourth aspect of the present invention, the ink-jet printer according to the first aspect further comprises a housing which houses the medium feed-in mechanism, the rotary drum, the medium holding section, the print head, the medium separating section, the medium feed-out mechanism, and the control section; an opening mechanism for opening the housing; and a lock mechanism for locking the opening mechanism during rotation of the rotary drum.

In the ink-jet printer of the first aspect, the medium holding section, the print head and the medium separating section are driven on the basis of the number of rotations of the rotary drum. In this case, it can be constructed such that the print head is operated after the holding of the print medium by the medium holding section is completed, and the medium separating section is operated after the printing of an image by the print head is completed. In other words, an image can be printed on a print medium without being adversely affected by positional deviation and vibration of the print medium which may occur due to an impact produced by the operation of the medium holding section and by positional deviation of the print medium which may occur due to an impact produced by the operation of the medium separating section. Since correct alignment can be achieved between print dots of inks ejected for each rotation of the rotary drum, the printing quality can be prevented from being deteriorated due to incorrect alignment between the print dots of the inks.

In the ink-jet printer of the second aspect, the rotary drum, the components of the medium feed-in mechanism and the medium holding section, which are mounted on the movable table, can be pulled out of the housing together with the table, for example, upon occurrence of medium jam. Therefore, the unnecessary print medium can be removed easily.

In the ink-jet printer of the third aspect, the print medium can be separated from the rotary drum promptly after completion of printing.

In the ink-jet printer of the fourth aspect, the opening mechanism is locked by the locking mechanism during rotation of the rotary drum. Accordingly, the user can be prevented from being injured by the rotation of the rotary drum during the jam state work or the maintenance work. In other words, the jam state work or the maintenance work can be carried out safely and easily.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An ink-jet printer according to a first embodiment of the present invention will be described with reference to FIGS. 1 to 10. This ink-jet printer is used to perform a multicolor printing on a sheet of paper M cut as a print medium. This paper sheet M is a plain paper or OHP sheet.

Figure 1:
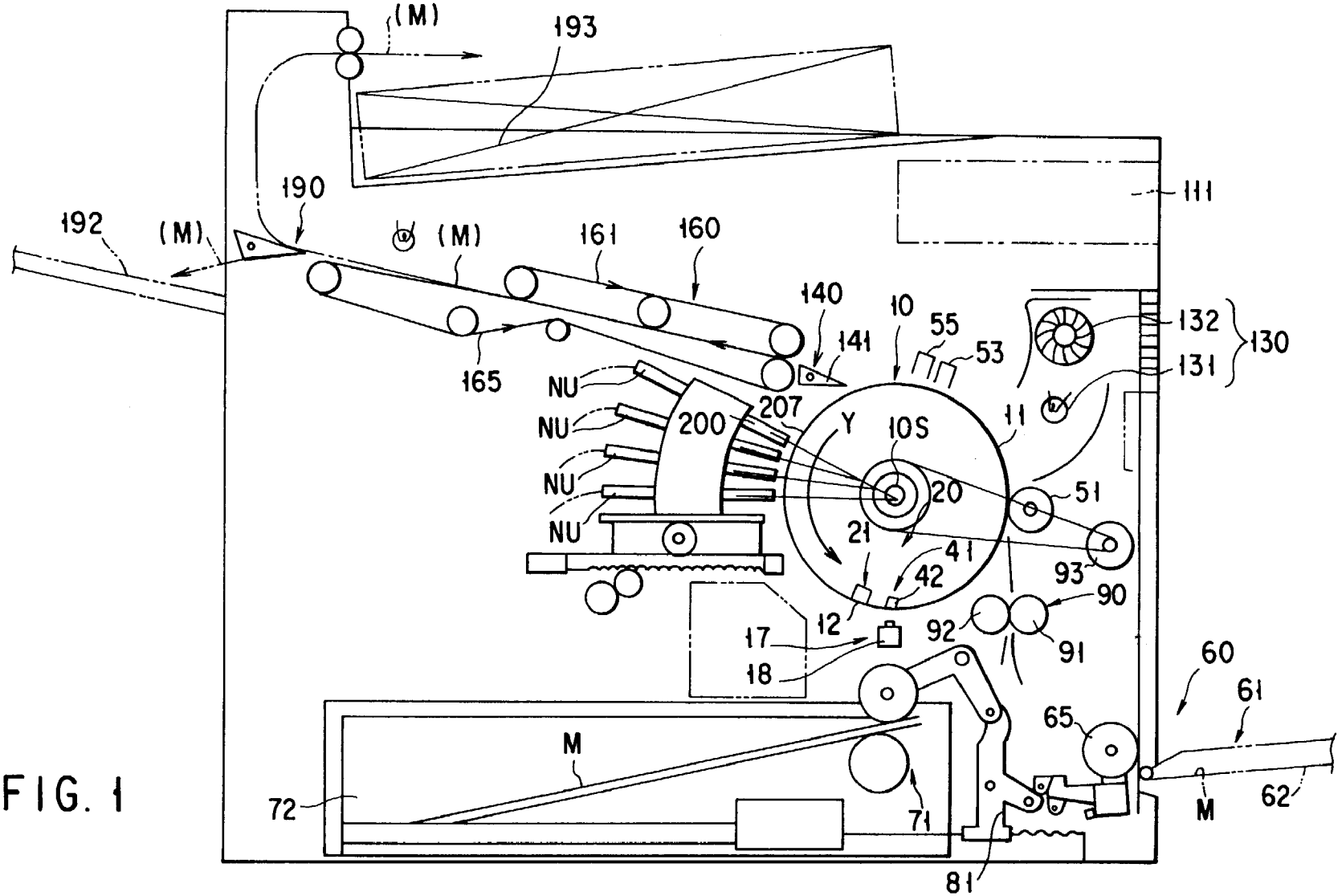
FIG. 1 is a sectional view showing the internal structure of an ink-jet printer according to a first embodiment of the present invention.

FIG. 1 shows the internal structure of the ink-jet printer. The ink-jet printer includes a rotary drum 10 which holds a paper sheet M and rotates at a predetermined circumferential speed; a print head 200 for performing a multicolor printing on the paper sheet M rotating together with the rotary drum 10; a manual feed tray 62 for placing a paper sheet M to be fed one by one; a paper cassette 72 for containing a stack of paper sheets M fed thereto; a sheet feed-in mechanism 60 for feeding a paper sheet M to the rotary drum 10 from the paper cassette 72 and the manual feed tray 62; a sheet feed-out mechanism 160 for feeding out the paper sheet M printed at the rotary drum 10; and a control unit 111 for controlling the overall operation of the ink-jet printer. As is shown in FIG. 1, the rotary drum 10 is located near the central position in a housing 1, the manual feed tray 62 is located below the rotary drum 10 and projects externally from a front surface of the housing 1, and the paper cassette 72 is located under the rotary drum 10. The sheet feed-in mechanism 60 is located between the manual feed tray 62 and the paper cassette 72. The print head 200 is located behind the rotary drum 10. The sheet feed-out mechanism 160 is located behind the rotary drum 10 and above the print head 200.

The rotary drum 10 is supported rotatably about a shaft 10S, and has a sheet holding system 20 for holding the paper sheet M wound around the peripheral surface 11 in accordance with rotation thereof. The rotational position of the rotary drum 10 is detected by a rotational position detector 17, which is disposed near the peripheral surface of the rotary drum 10. The print head 200 is constituted by four nozzle units NU which are arranged along the peripheral surface 11 of the rotary drum 10 and performs printing on the paper sheet M with yellow, cyan, magenta and black inks, respectively. These nozzle units NU are supplied with the respective inks from four ink supply sections 210 disposed apart therefrom. Each nozzle unit NU has a plurality of ink-jet nozzles 207 which are arranged at a pitch PT of, for example, 1/75 inch in the axial direction of the rotary drum 10 to eject ink of a corresponding color onto the paper sheet M. The ink-jet, nozzles 207 are arranged to have a length corresponding to the width of the paper sheet M of A4 size, i.e., 210 mm. The sheet feed-in mechanism 60 includes a sheet loader 90 for loading the paper sheet M to the rotary drum 10 such that the width direction of the sheet is aligned with the axial direction of the rotary drum 10; a manual feeder 61 for taking the paper sheet M from the manual feed tray 62 and feeding it to the sheet loader 90; a cassette feeder 71 for taking the paper sheet M from the paper cassette 72 and feeding it to the sheet loader 90; and a feed switch section 81 for driving one of the manual feeder 61 and the cassette feeder 71. The sheet loader 90 is controlled to load the paper sheet M toward the rotary drum 10 when the position detector 17 has detected that the rotary drum 10 has arrived at a predetermined position. The paper sheet M is held on the peripheral surface 11 of the rotary drum 10 by means of the sheet holding system 20. The print head 200 prints a color image on the paper sheet M as the rotary drum 10 rotates.

After printing, the paper sheet M is separated from the peripheral surface 11 of the rotary drum 10 by a separating claw 141 of a sheet separator 140, and fed in a predetermined direction by the sheet feed-out mechanism 160. A discharge switch 190 guides the paper sheet M to a selected one of a rear discharge tray 192 for discharging the sheet with its printed surface facing upward, and an upper discharge tray 193 for discharging the sheet with its printed surface facing downward.

The print head 200 is movable in a main scanning direction X parallel to the axis of the rotary drum 10, and is also movable between a print position adjacent to the peripheral surface 11 of the rotary drum 10, and a stand-by position remote from the print position.

The rotary drum 10 holds the paper sheet M wound on the peripheral surface 11 thereof and rotates such that the sheet is opposed to the nozzle units NU and moved in a sub-scanning direction Y perpendicular to the main scanning direction X. The rotary drum 10 is kept at a constant rotational speed of 120 rpm to achieve a multicolor printing of, for example, 20 PPM. That is, the rotary drum 10 is rotated at one revolution per 0.5 sec. During printing, each nozzle unit NU is shifted in the main scanning direction X by a constant rate of ¼ nozzle pitch PT each time the rotary drum 10 makes one revolution, so that it moves by a distance equal to the nozzle pitch PT during four revolutions. With this structure, the printing of the entire paper sheet M is completed in 2 seconds (=0.5 second×4) required to make four revolutions of the rotary drum 10. Even taking into consideration a time required to make one revolution of the rotary drum 10 for winding up the paper sheet M before printing and one revolution of the rotary drum 10 for separating the paper sheet M after printing, a multicolor image can be printed on the paper sheet M of A4 size at a high speed of 3 (=2+1) seconds per sheet. Thus, printing can be consecutively performed on 20 paper sheets every minute.

The sheet loader 90 is constituted by at least a pair of loading rollers 91 and 92 extending in the axial direction of the drum to load the paper sheet M fed from the feeder 61 or 71 to the rotary drum 10 at a predetermined timing. The loading speed of the paper sheet M is set at a value corresponding to the circumferential speed of the rotary drum 10.

At least one of the loading rollers 91 and 92 receives a rotating force applied from a main motor 93 which constitutes a feed force applying section together with a gear train, a clutch, and the like. The main motor 93 drives the loading rollers 91 and 92 under the control of the control unit 111, thereby forwarding the paper sheet M to the rotary drum 10.

Figure 8:
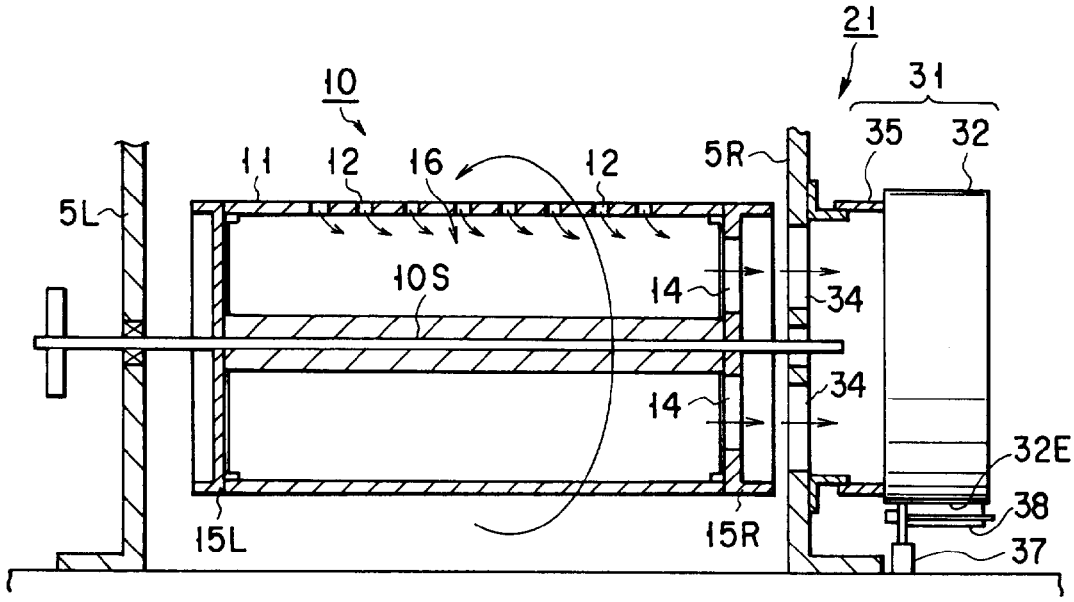
FIG. 8 is a view for explaining the structure of a negative-pressure suction holding section coupled with the rotary drum shown in FIG. 1.

As is shown in FIG. 8, the rotary drum 10 is rotatably supported by brackets 5L and 5R having bearings on the both sides of the shaft 10S, and rotated by the driving force of the main motor 93 transmitted to the shaft 10S via a timing belt, sprockets and gears. The main motor 93 is constituted by a servo motor, which has excellent quick-response and constant-speed characteristics. In this embodiment, the rotary drum 10 is constituted by a cylindrical frame of, e.g., an aluminum alloy, which has a hollow portion 16 and electrically grounded. Since the diameter of the rotary drum 10 is set at 130 mm, a circumferential speed of 816 mm/sec=120 $\pi d/60$ is obtained. The peripheral surface 11 of the rotary drum 10 has a width of about 220 mm in the axial direction and a length of 408 mm (=$\pi d$) in the rotational direction. For this reason, the rotary drum 10 can satisfactorily hold an A4-size paper sheet M having a length of 297 mm and a width of 210 mm.

The rotational position detector 17 is constituted by suction holes 12 serving as a detection target on the rotary drum 10 side and a sensor 18 for detecting the detection target. The detection target is not limited to the suction holes 12, but may be, for example, cutouts or projections provided at the rotary drum 10.

The rotational position detector 17 is referred to by the control unit 111 in a sequence of driving the sheet holding system 20, the print head 200 and the sheet separator 140 on the basis of the number of rotations of the rotary drum 10.

The control unit 111 is constituted by a CPU 112, a ROM 113, a RAM 114, a keyboard 115, a display 116, a timepiece circuit 117, an input and output port 118, etc. The input and output port 118 is connected to a negative-pressure suction holding section 21 incorporated in the sheet holding system 20, a clamp-claw holding unit 41, a charger 51, the print head 200, the sheet separator 140, etc. When it is detected by the rotational position detector 17 that the rotary drum 10 has arrived at the predetermined position, the sheet loader 90 is driven by the driving force from the main motor 93 supplied under the control of the control unit 111, thereby loading the paper sheet M to the rotary drum 10.

As is shown in FIGS. 4 to 9, the sheet holding system 20 includes the clamp-claw holding unit 41 and the negative-pressure suction holding section 21, and is arranged such that the paper sheet M can be held on the peripheral surface 11 of the rotary drum 10 by the clamp claw 42 and by negative-pressure suction.

As is shown in FIGS. 4, 5, 6 and 7, the clamp-claw holding unit 41 uses the clamp claw 42 to clamp the leading end of the paper sheet M to the peripheral surface 11 of the rotary drum 10.

More specifically, the clamp-claw holding unit 41 is constituted by the clamp claw 42, a normally clamping mechanism 43, a normally release locking mechanism 44, an unlocking mechanism 45 and a lock resuming mechanism 46. The clamp claw 42, the normally clamping mechanism 43 and the normally release locking mechanism 44 are mounted on one end side of the rotary drum 10, which is a movable. The unlocking mechanism 45 and the lock resuming mechanism 46 are attached to a bracket (not shown) in the housing 1, which is stationary. The unlocking mechanism 45 and the lock resuming mechanism 46 are associated with the normally clamping mechanism 43 and the normally release locking mechanism 44, to control clamping and releasing operations of the clamp claw 42 by properly using rotation of the rotary drum 10.

Each component of the clamp-claw holding unit 41 will be described in detail.

The clamp claw 42 is arranged to clamp (press) the paper sheet M against the peripheral surface 11 of the rotary drum 10. Specifically, the clamp claw 42 has a claw 42F, an engaging portion 42C and a sector gear 42G, and is pivotally attached to a pin 42P. An edge portion (e.g. the leading end) of the paper sheet M is clamped against the peripheral surface 11 of the rotary drum by means of the claw 42F.

The normally clamping mechanism 43 is made up of a lever 43L (with a proximal end 43B and a distal end 43F) pivoted about a pin 43P, a sector gear 43G which is disposed on the distal end 43F and engaged with the sector gear 42G, and a spring 43SP hooked between the distal end 43B and a fixing portion 43R. The mechanism 43 normally keeps the clamp claw 42 in a clamping state as indicated by the two-dot chain lines in FIG. 4, using the urging force (tension) of the spring 43SP.

Figure 4:
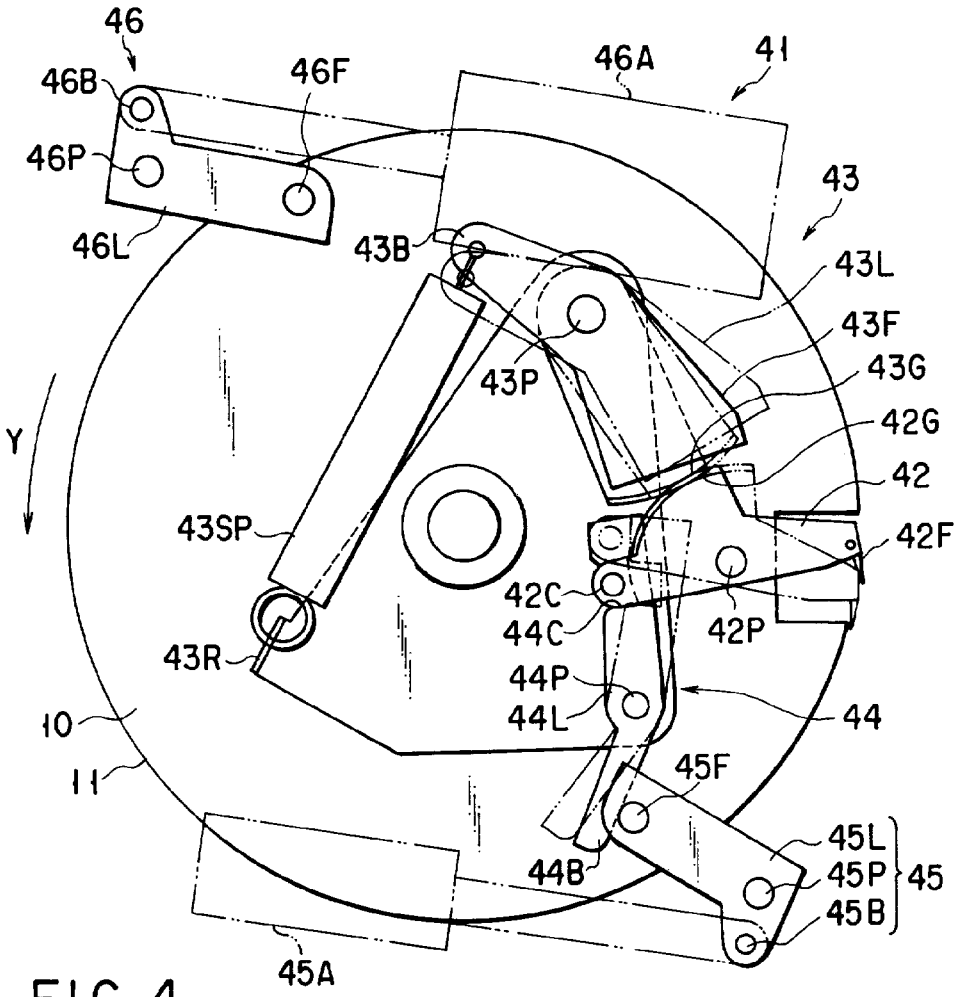
FIG. 4 is a side view showing in detail a clamp-claw holding unit incorporated in a sheet holding system shown in FIG. 1.
Figure 5:
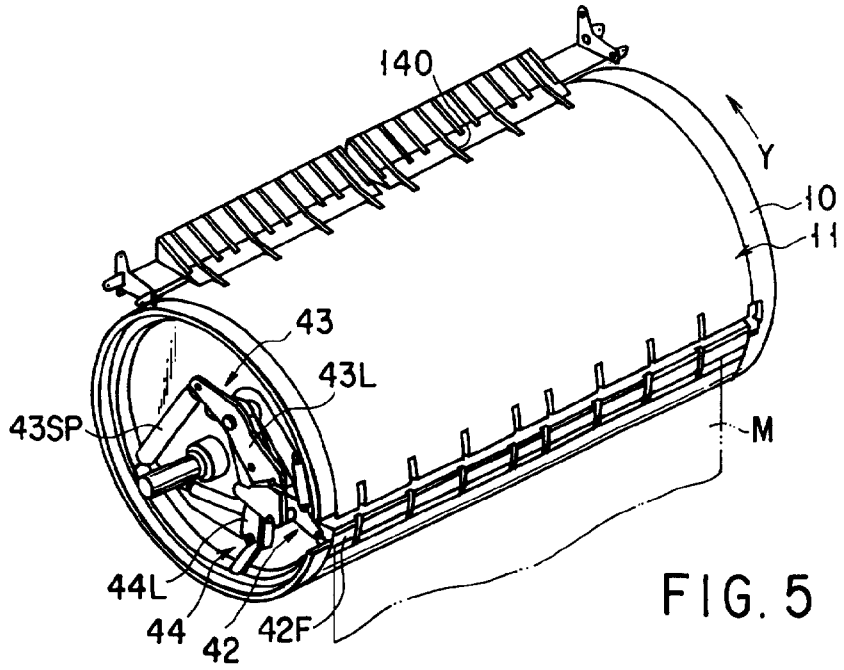
FIG. 5 is a perspective view of a rotary drum in which the clamp-claw holding unit shown in FIG. 4 is incorporated.

The normally release locking mechanism 44 is made up of a lock lever 44L pivoted about a pin 44P, and a spring (not shown) urging the lock lever 44L counterclockwise in FIG. 4. An engaging groove 44C of the lock lever 44L is formed such that it can be engaged with and disengaged from an engaging portion 42C of the clamp claw 42. When the former 44C and the latter 42C are engaged with each other, the clamp claw 42 is kept in a clamp releasing state as indicated by the solid line in FIG. 4.

The unlocking mechanism 45 is made up of a lever 45L (a distal end 45F and a proximal end 45B) pivotal about a pin 45P of the stationary side, and an actuator 45A. When the actuator 45A rotates the lever 45L clockwise about the pin 45P, the distal end 45F made up of a pin engages with the proximal end 44B of the lock lever 44L which is moved in accordance with rotation of the rotary drum 10. Then, the lock lever 44L is rotated clockwise and disengaged from the clamp claw 42 (42C). Accordingly, the clamp claw 42 becomes to a clampable state by the urging force of the spring 43SP. In other words, the normally release locking state is canceled.

Figure 6:
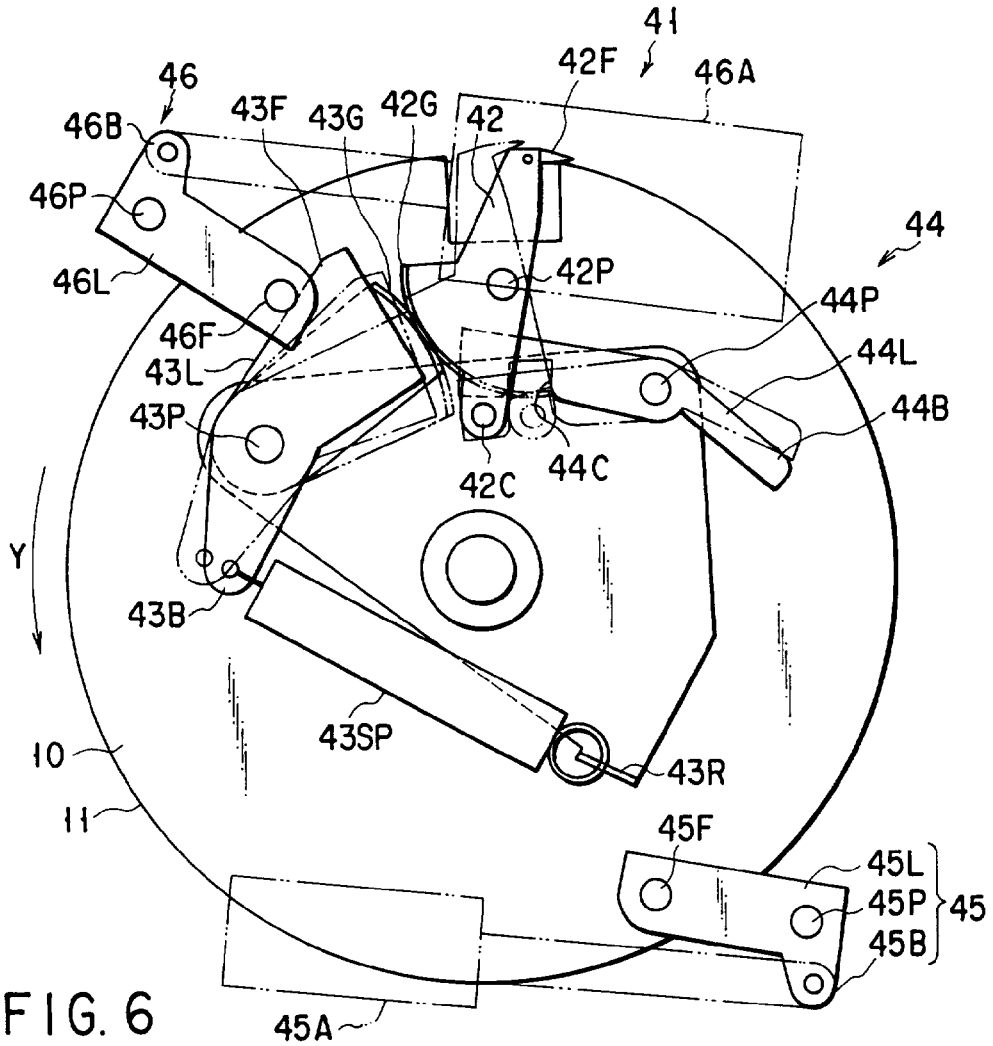
FIG. 6 is a side view of the clamp-claw holding unit actuated upon rotation of the rotary drum in a Y direction shown in FIG. 5.
Figure 7:
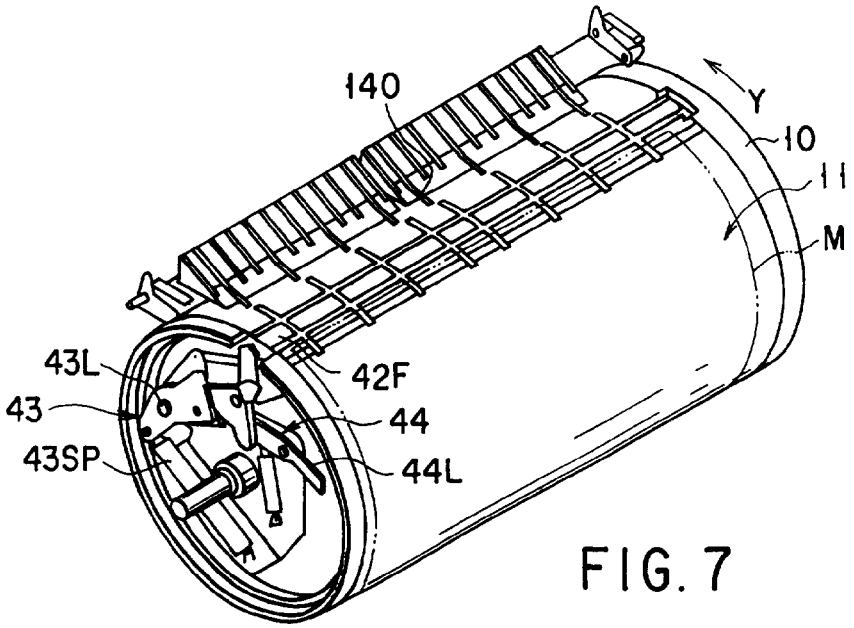
FIG. 7 is a perspective view of the rotary drum rotated in the Y direction shown in FIG. 5.

The lock resuming mechanism 46 is made up of a lever 46L (a distal end 46F and a proximal end 46B) pivotal about the pin 46P of the stationary side, and an actuator 46A, as is shown in FIG. 6. When the actuator 46A rotates the lever 46L clockwise about the pin 46P, the distal end 46F made up of a pin in the lever 46L presses against the lever 43L which is moved in accordance with the rotation of the rotary drum 10, and sets the clamp claw 42 in a clamp releasing state as indicated by the two-dot chain lines, via the sector gears 43G and 42G. Accordingly, the engaging portion 42C of the clamp claw 42 engages with the engaging groove 44C of the lock lever 44L (44F). In other words, the normally clamp locking state of the clamp claw 42 can be resumed.

Figure 9:
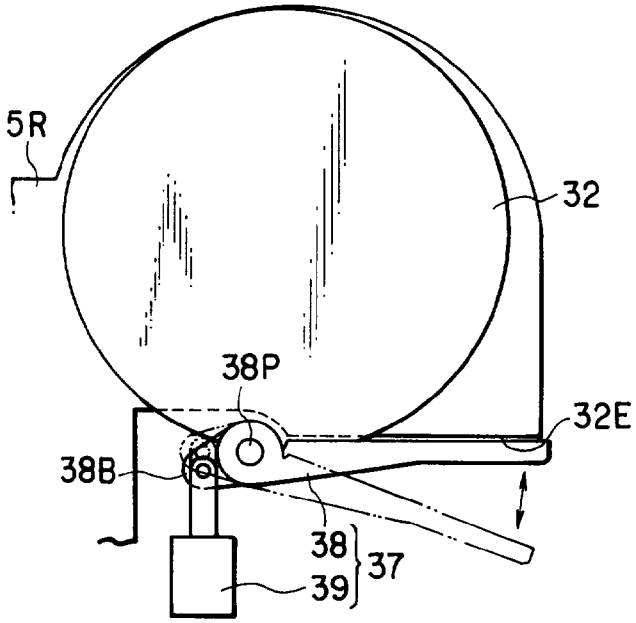
FIG. 9 is a view for explaining the structure of a negative-pressure control mechanism shown in FIG. 8.

As is shown in FIGS. 8 and 9, the negative-pressure suction holding section 21 includes a negative-pressure creating section 31 and suction holes 12 formed in the peripheral surface 11 of the rotary drum. The negative-pressure creating section 31 is arranged to hold the paper sheet M via the suction holes 12 by creating a negative pressure in the internal space 16 of the drum.

The negative-pressure creating section 31 is constituted by a suction port 34 facing a suction port 14 on the rotary drum 10 side, and a suction fan 32 for suctioning air from the suction port 34 through a duct 35 to create a negative pressure in the space 16.

The suction port 14 is formed in an end-surface plate 15R of the rotary drum 10, and the suction port 34 is formed in the bracket 5R fixed to the housing 1 so as to face the suction port 14. Therefore, the end-surface plate 15R of the rotary drum 10 and the bracket 5R of the negative-pressure creating section 31 do not contact each other although they come close to each other in the axial direction of the drum. The other end-surface plate 15L is a blind plate. In addition, reference numeral 10S denotes the rotary shaft of the rotary drum 10.

In this embodiment, a negative-pressure control mechanism 37 is provided as shown in FIG. 9 for opening and closing an outlet 32E which is formed in the suction fan 32 to drive out sucked air. The negative-pressure control mechanism 37 includes a damper 38 supported below the suction fan 32 and pivotal about a pin 38P, and an actuator 39 coupled with the proximal end 38B of the damper 38.

The outlet 32E of the suction fan 32 is opened by driving the actuator 39 such that the damper 38 is rotated clockwise from its closed position indicated by the solid lines in FIG. 9, and is closed by driving the actuator 39 such that the damper 38 is returned to the closed position. During the operation of the suction fan 32, a negative pressure appears is created in the internal space 16 of the rotary drum 10 when the outlet 32 is opened, and extinguished when the outlet 32E is closed.

Electrostatic suction holding is additionally performed by the charger 51 formed of a charging roller as shown in FIG. 1. The charger 51 charges the paper sheet M with positive charge, thereby causing the paper sheet M to be held on the peripheral surface 11 of the grounded rotary drum 10 by an electrostatic attraction force generated between the sheet M and the rotary drum 10. A supplementary charger 53 is provided for supplementing the electrostatic attraction force by an amount attenuated due to execution of printing. After printing, a discharger 55 removes the charge for electrostatic attraction by applying charge opposite to that applied from the charger 51.

Figure 10:
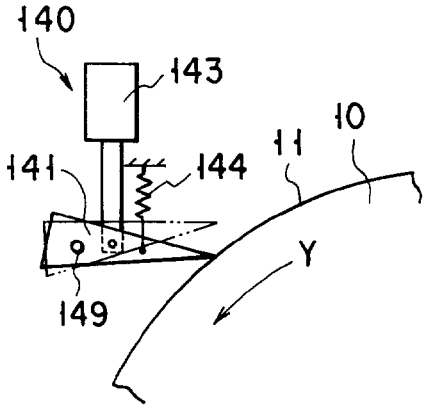
FIG. 10 is a view for explaining the structure of a sheet separator shown in FIG. 1.

Referring then to FIG. 10, the sheet separator 140 includes a separating claw 141 disposed on the stationary body (the main body frame) and pivotal about a support rod 149, a spring 144 urging the separating claw 141 in a direction away from the peripheral surface 11 of the rotary drum 10, and an actuator 143 for rotating the separating claw 141 clockwise against the urging force of the spring 144 to put the claw into contact with the peripheral surface 11 of the rotary drum, and is arranged so that the paper sheet M can be separated from the peripheral surface 11 of the rotary drum after printing.

Figure 2:
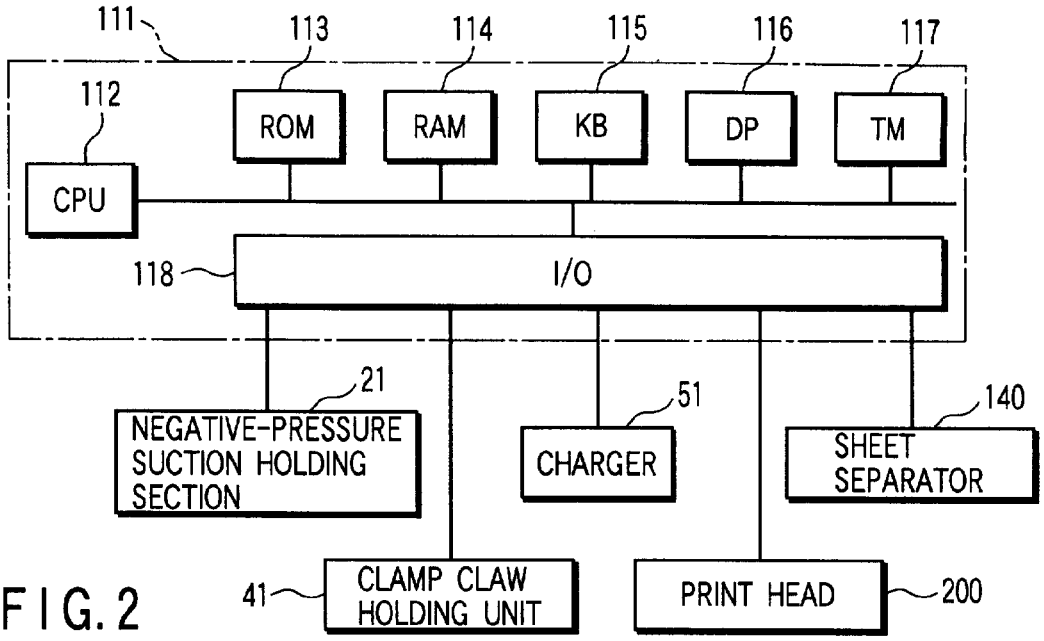
FIG. 2 is a circuit diagram showing a control unit incorporated in the ink-jet printer shown in FIG. 1.
Figure 3:
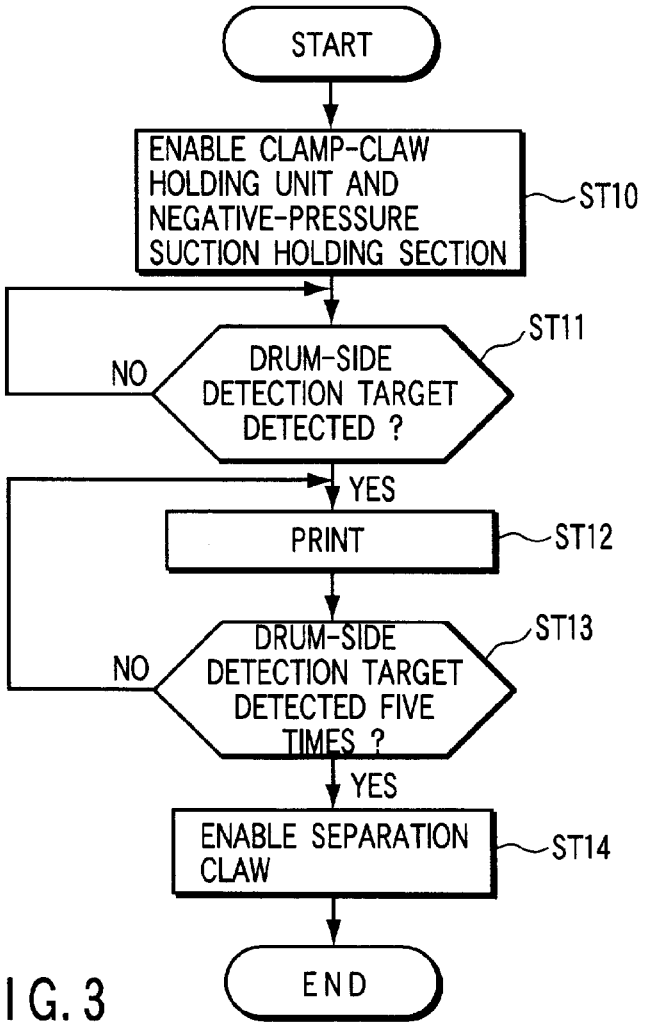
FIG. 3 is a flowchart for explaining a control operation of the control unit shown in FIG. 2.

The operation of the above ink-jet printer will be described with reference to the flowchart shown in FIG. 2.

The paper sheet M is loaded from the sheet loader 90 to the peripheral surface 11 of the rotary drum 10 at the same speed as the circumferential speed of the drum. On the other hand, the damper 38 is opened in step ST10 upon loading of the paper sheet M while the suction fan 32 of the negative-pressure suction holding section 21 is driven, thereby creating a negative pressure in the internal space 16 of the rotary drum 10. As a result, a leading end of the paper sheet M is held on the peripheral surface 11 of the rotary drum by a negative pressure applied through the suction holes 12. Thereafter, the actuator 46A of the clamp-claw holding unit 41 driven so that the paper sheet M is clamped by the clamp claw 42.

In addition, the paper sheet M is discharged while passing between the charger 51 and the peripheral surface 11 of the rotary drum. The above-described operation of holding the paper sheet M on the peripheral surface 11 of the rotary drum is completed during one revolution of the rotary drum 10.

If the detection target, i.e. the suction holes 12, on the rotary drum 10 side is detected in step ST11 by the sensor 18 (for the first time) after the paper sheet M has been held, the control unit 111 determines that the rotary drum 10 has made one revolution after the start of the sheet holding operation, and drives the print head 200 to start printing.

The printing for the paper sheet M completes after four revolutions of the rotary drum 10. If it is detected in step ST13 that the present detection of the suction holes 12 on the rotary drum 10 side by the sensor 18 is the fifth-time detection, the control unit 111 drives in step ST14 the actuator 143 of the sheet separator 140 to put the separating claw 141 into contact with the peripheral surface 11 of the rotary drum.

In addition, after the completion of printing and immediately before the operation of the separating claw 141, the clamping of the leading end of the paper sheet M by the clamp claw 42 is released, and negative-pressure suction is ceased. At the same time, the discharger 55 starts electrostatic discharging from the paper sheet M. Accordingly, the paper sheet M is smoothly and reliably separated from the peripheral surface 11 of the rotary drum by the separating claw 141.

Since printing is started after the paper sheet M is completely held, an impact produced at the time when the leading end of the paper sheet M is clamped by the clamp claw 20 of the sheet holding system 20 ceases before the start of printing. Further, since the clamp releasing operation of the clamp claw 42 is carried out after completion of printing, the printing is not adversely affected by an impact produced due to the clamp releasing operation. Further, the separating claw 141 is operated to start the sheet separating operation after the printing is fully completed. Therefore, positional deviation of the paper sheet M would not occur during the printing. This prevents vibration of the paper sheet M, so that a high quality printing can be achieved.

As described above, in the first embodiment, the sequential operations of holding, printing, and separating for a paper sheet M are performed in individual revolutions of the rotary drum 10. Therefore, printing operation is not adversely affected, for example, by vibration which may occur upon the clamping and clamp releasing operations of the paper sheet M made by the clamp claw 42. As a result, a high quality image can be printed reliably.

An ink-jet printer according to a second embodiment of the present invention will be described with reference to FIG. 11.

In the first embodiment, a number of process components 51, 131, . . . are closely disposed around the rotary drum 10. Therefore, even when a side cover CV is opened, it is difficult to remove a jammed sheet or paper particles stuck to the peripheral surface 11 of the rotary drum 10. This makes the handling of the printer troublesome, and impairs the high speed printing. The ink-jet printer of the second embodiment is used for solving these problems.

Figure 11:
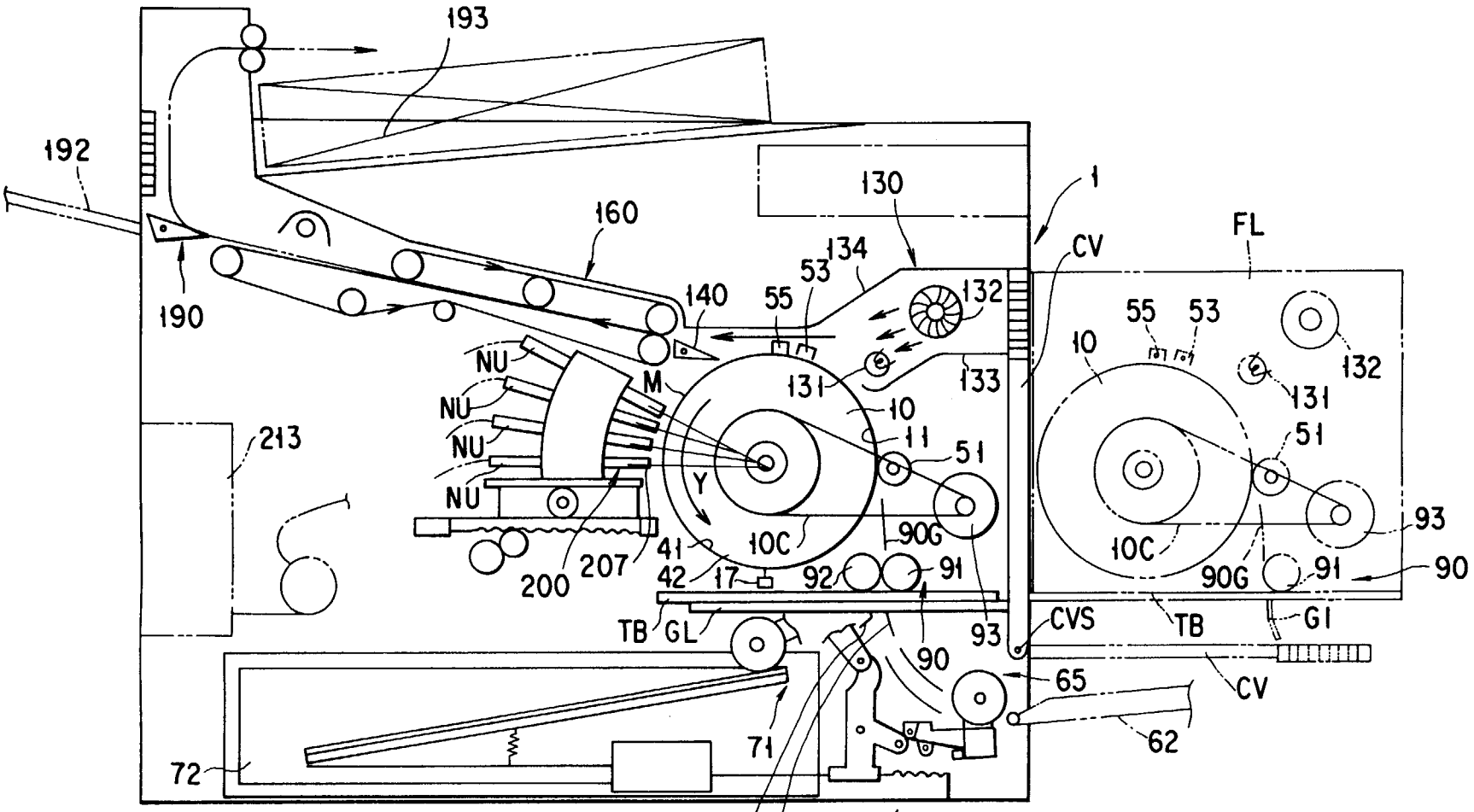
FIG. 11 is a sectional view showing the internal structure of an ink-jet printer according to a second embodiment of the present invention.

FIG. 11 shows the internal structure of this ink-jet printer. This printer has substantially the same structure as the ink-jet printer of the first embodiment except for the matters mentioned below. Therefore, components similar to those employed in the first embodiment are denoted by the same reference numerals, and explanations thereof are omitted.

This ink-jet printer is arranged such that at least the rotary drum 10, the sheet loader 90 and a part or all of the sheet holding system 20 is attachable and detachable to the housing 1. The rotary drum 10 is rotated in the Y-direction at the same circumferential speed as in the first embodiment by a driving section made up of the main motor 93, the timing belt 10C, etc. The sheet holding system 20 is arranged such that the charger 51 formed of a charging roller charges the paper sheet M to apply an electrostatic attraction force, and the negative-pressure suction holding section 21 is additionally used. The sheet holding system 20 includes, on the rotary drum 10 side, suction holes 12 for causing a leading end of the paper sheet M to be held on the peripheral surface 11 by use of negative pressure, and a clamp claw 42 for mechanically clamping the paper sheet M. The system 20 further includes a supplementary charger 53 and a discharger 55 which are disposed along the peripheral surface 11 of the rotary drum 10 and on the downstream side of the charging roller 51. The supplementary charger 53 supplements the electrostatic attraction force by an amount attenuated during printing, and the discharger 55 removes the electrostatic attraction force before the sheet separating operation of the sheet separator 140.

The ink-jet printer has a guide rail GL disposed in the housing 1 and a movable table TB for moving along the guide rail GL. As is indicated by the solid lines in FIG. 11, the movable table TB is settled in the housing 1 when the side cover CV is closed, whereas as is indicated by the two-dot chain lines, the table TB is pulled out of the housing 1 when the side cover CV is open.

The rotary drum 10 is rotatably supported by a pair of vertical frames FL attached to the movable table TB. At least the rotary drum 10, the sheet loader 90, and those components of the sheet holding system 20 in which a sheet jam can easily occur or in which much labor is required to eliminate the jam are mounted on the frames FL. More specifically, the loading roller 91, the guide 90G and the charger 51 are mounted on the frames FL together with rotary drum 10 such that they have a predetermined positional relationship.

The main motor 93, the timing belt 10C, a guide G1, a fan 132, a heater 131, the supplementary charger 53 and the discharger 55 are also mounted.

The loading roller 92 and a guide G2 are mounted on a bracket (not shown) in the housing 1, so that they can be separated from the components on the movable table. Concerning an ink drying and fixing section 130, it has a duct member 133 detachably attached to the side cover CV, and a duct member 134 fixed to the housing 1.

If in the above-described second embodiment, a jam occurs, the side cover CV is opened horizontal about a spindle CVS as indicated by the two-dot chain lines, and the movable table TB is pulled out of the housing 1 along the guide rail GL. As a result, the rotary drum 10 and the components 91, 90G, 51, 131, 53 and 55 disposed around the rotary drum 10 are moved outside the housing 1 together with the movable table TB. Thus, a work of removing a jammed paper or paper particles can be promptly carried out in a simple manner.

Further, a jam occurs very easily in the sheet loader 90. Since in this case, the loading roller 91 and the guide G1 are separated from the loading roller 92 and the guide G2 when the movable table TB is pulled out, the jammed sheet can be easily and promptly removed.

In addition, since the rotary drum 10 is located on the movable table TB together with the main motor 93 and the timing belt 10C, the jam can be easily remedied by manually rotating the rotary drum 10.

Since the relative positional relationship between the rotary drum 10 and the other components 91, 90G, 51, 131, 53 and 55 is maintained on the movable table TB, printing can be restarted immediately after the movable table TB is returned into the housing 1 upon completion of the work for a sheet jam. This contributes to high-speed printing.

An ink-jet printer according to a third embodiment of the present invention will be described with reference to FIGS. 12 and 13.

This ink-jet printer is used to separate the paper sheet M more quicker than the ink-jet printer of the first embodiment, without degrading the printing quality.

Figure 12:
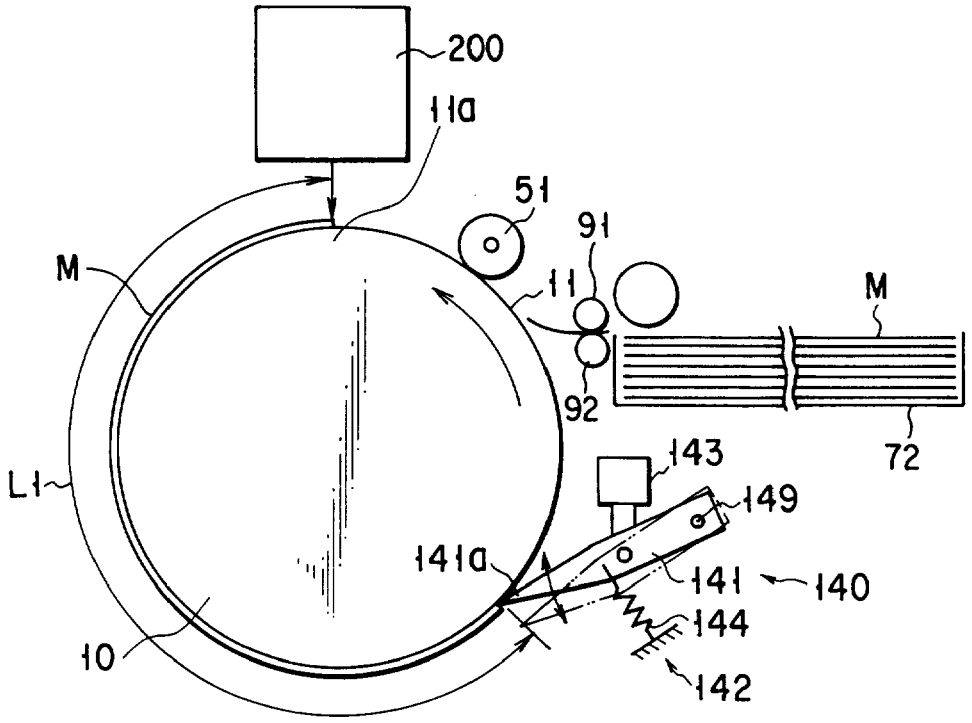
FIG. 12 is a sectional view showing the structure of an essential part of an ink-jet printer according to a third embodiment of the present invention.
Figure 13:
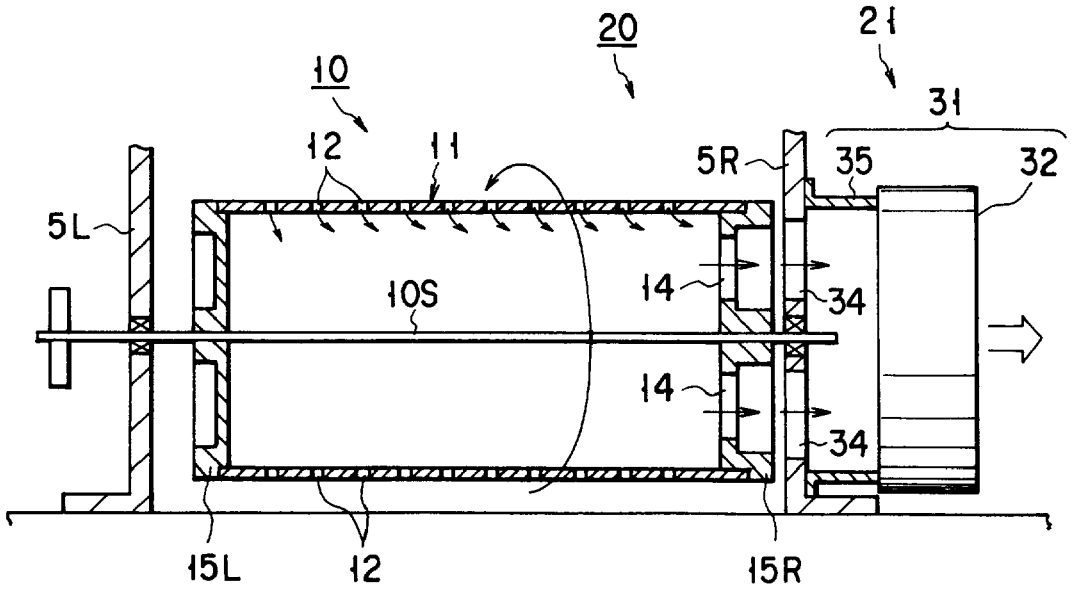
FIG. 13 is a view for explaining the structure of a negative-pressure suction holding section coupled with the rotary drum shown in FIG. 12.

FIG. 12 shows the structure of an essential part of the ink-jet printer, and FIG. 13 shows the structure of a negative-pressure suction holding section 21 coupled with a rotary drum 10 shown in FIG. 12. This ink-jet printer is substantially similar to that of the first embodiment except for the matters mentioned below. Therefore, components similar to those in the first embodiment are denoted by the same reference numerals, and explanations thereof are omitted.

In this ink-jet printer, the sheet holding system 20 and the sheet separator 140 are arrange such that a leading end of the paper sheet M can be separated from the rotary drum 10 immediately after printing.

The sheet holding system 20 holds the paper sheet M on the rotatably rotary drum 10, using an electrostatic attraction force and a negative-pressure suction force.

Electrostatic attraction is attained by a charger 51 shown in FIG. 12. The charger 51 charges the paper sheet M with positive charge, thereby causing the paper sheet M to be held on the peripheral surface 11 of the grounded rotary drum 10 by an electrostatic attraction force generated between the sheet M and the rotary drum 10.

The negative-pressure suction is attained by the negative-pressure suction holding section 21 shown in FIG. 13. The negative-pressure suction holding section 21 includes a plurality of suction holes 12 which extend through the rotary drum 10 to communicate with the internal and external spaces, and a negative-pressure creating section 31 for creating a negative pressure in the internal space of the rotary drum 10, and is arranged such that the paper sheet M can be held on the peripheral surface 11 of the rotary drum by negative-pressure suction. The negative-pressure creating section 31 is constituted by a suction port 34 facing the suction port 14 on the rotary drum 10 side, and a suction fan 32 for suctioning air via the suction port 34 and a duct 35 to create a negative pressure in the internal space 16 of the rotary drum 10.

The suction port 14 is formed in an end-surface plate 15R of the rotary drum 10, and the suction port 34 is formed in the bracket 5R fixed to the housing 1 so as to face the suction port 14. The end-surface plate 15R of the rotary drum 10 and the bracket 5R of the negative-pressure creating section 31 do not contact each other although they come close to each other in the axial direction of the drum. The other end-surface plate 15L is a blind plate.

The sheet separator 140 is used to separate the paper sheet M from the peripheral surface 11 of the rotary drum 10, and disposed at a position where a leading end of the paper sheet M can be separated from the rotary drum 10 immediately after completion of printing. In this embodiment, the sheet separator 140 includes a separation claw 141 and a separation claw driving section 142, and is arranged to separate the paper sheet M from the peripheral surface 11 by inserting the separation claw 141 between the peripheral surface 11 of the rotary drum 10 and the paper sheet M.

More specifically, the separation claw 141 is disposed at a position spaced from the print head 200 by L1 corresponding to the length of the paper sheet M along the peripheral surface 11 of the rotary drum, and pivotal about a spindle 149. With this structure, since the leading end of the paper sheet M has arrived at the separation claw 141 when the printing is completed, the paper sheet M can be quickly separated from the rotary drum 10.

The separation claw driving section 142 includes an actuator 143 and a spring 144 which are connected to center portions of the separation claw 141. The spring 144 is used to urge the separation claw 141 counter-clockwise in FIG. 12 and set it at a stand-by position where the tip 141*a* of the separation claw 141 is kept away from the peripheral surface 11 of the rotary drum. The actuator 143 is used to rotate the separation claw 141 against the urging force of the spring 144 and set it at a position where the tip 141*a* of the separation claw 141 is brought into contact with the peripheral surface 11 of the rotary drum.

Thus, when the actuator 143 is driven, the tip 141*a* of the separation claw 141 is set at the position where it is brought into contact with the peripheral surface 11 of the rotary drum. On the other hand, when driving of the actuator 143 is stopped, the tip 141*a* is set at the stand-by position where it is kept away from the peripheral surface 11 of the rotary drum by the urging force of the spring 144.

As described above, during the rotation of the rotary drum 10, the paper sheet M is held on the drum 10 by the electrostatic attraction force and the negative-pressure suction force, and an image is printed on the sheet while the sheet passes the print head 200. The leading end of the paper sheet M is separated from the rotary drum 10 by the separation claw 141 immediately after completion of printing. Since the paper sheet M is held on the rotary drum 10 until the completion of printing, and separated therefrom immediately after the completion, the holding ability is not influenced due to changes in the electrostatic attraction force and the negative-pressure suction force during the printing. Accordingly, the paper sheet M can be separated quickly without causing the printing to be unstable.

Figure 14:
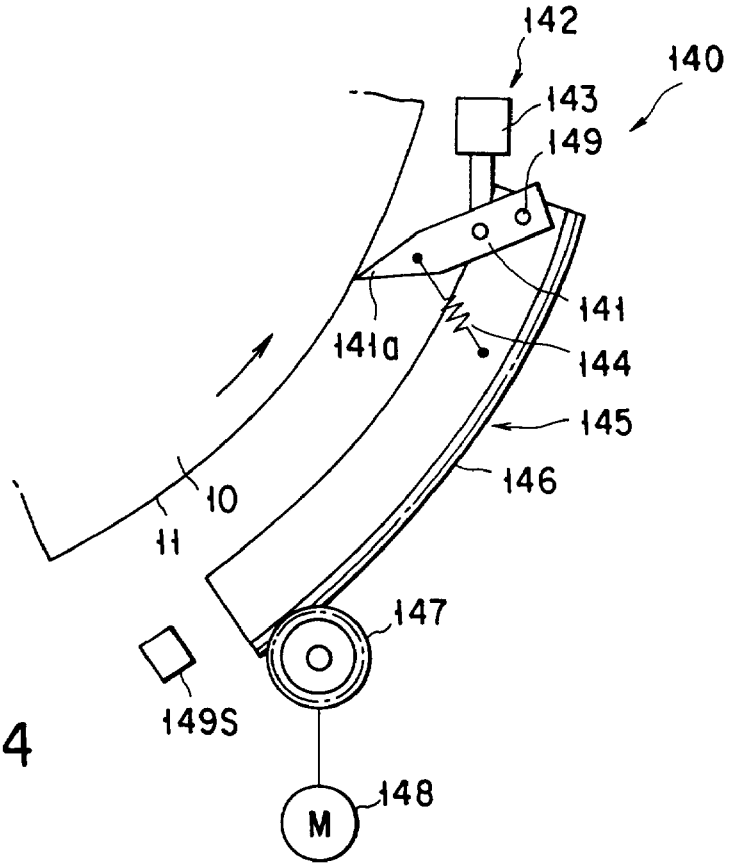
FIG. 14 is a view showing a first modification of a sheet separator shown in FIG. 12.

FIG. 14 shows a first modification of the sheet separator 140 of FIG. 12.

In the first modification, a position adjuster 145 is provided for changing the position of the sheet separator 140 in accordance with the length of the paper sheet M. The position adjuster 145 includes a driven gear member 146 for holding the separating claw 141 and moving the claw along the peripheral surface 11 of the rotary drum, a driving gear member 147 engaged with the driven gear 146 to transmit the rotational force thereto, a motor 148 for rotating the driving gear 147, and a sensor 149S which can detect the position of the separating claw 141. The section 145 performs position adjustment by moving the separating claw 141 along the peripheral surface 11 of the rotary drum.

In the above-described structure, the paper sheet M is held on the rotary drum 10 by the electrostatic attraction force and the negative-pressure suction force during the rotation of the drum, and image is printed thereon when the paper sheet M passes the print head 200. During the printing, the electrostatic attraction force and the negative-pressure suction force do not change since the tip 141*a* of the separating claw 141 is set in the stand-by position without contacting the paper sheet M. Accordingly, the printing is prevented from being unstable.

Immediately after completion of the printing, the actuator 143 is driven to put the tip 141*a* of the separating claw 141 into contact with the peripheral surface 11 of the rotary drum. As a result, the tip 141*a* of the separating claw 141 is inserted between the paper sheet M and the peripheral surface 11 of the rotary drum, thereby separating the paper sheet M.

When the type of the paper sheet M is changed to another one, the length of the paper sheet M is detected using an operation-panel switch of the printer or a sensor (not shown) disposed on a path for feeding the paper sheet M, and the position adjuster 145 is driven on the basis of the detection result, thereby situating the separating claw 141 at a position determined according to the length of the paper sheet M. Thus, the separating claw 141 can separate the paper sheet M of a variable length from the rotary drum 10 immediately after completion of the printing.

Figure 15:
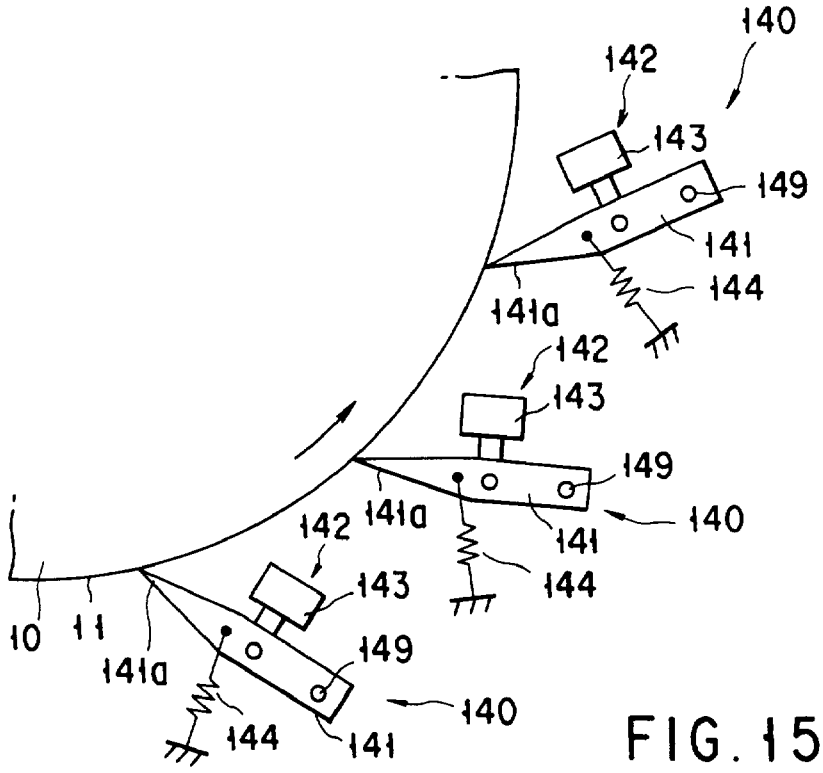
FIG. 15 is a view showing a second modification of the sheet separator shown in FIG. 12.

FIG. 15 shows a second modification of the sheet separator 140 of FIG. 12.

In the second modification, for example, three sheet separators 140 are arranged along the peripheral surface 11 of the rotary drum 10, and spaced from each other. The positions of the sheet separators 140 are determined according to the lengths of three types of paper sheets M. Specifically, the separating claw 141 of each sheet separator 140 is spaced from the print head 200 by the length of a corresponding paper sheet M along the peripheral surface 11 of the rotary drum, and pivotal about a spindle 149. With this structure, the leading end of each paper sheet M reaches a corresponding separation claw 141 at the time when the printing is completed. Therefore, the paper sheet M can be separated from the rotary drum 10 promptly.

As described above, each paper sheet M can be separated promptly from the rotary drum 10 without causing the printing to be unstable, by selectively driving one of the three sheet separators 140 according to the type of the paper sheet M.

Additionally, the sheet feed-out mechanism 160 must have a structure adapted to the position of each sheet separator 140 in the first and second modifications.

Moreover, although the sheet separator 140 employs the separating claw 141, the separator 140 may use a discharger for applying voltage of a polarity opposite to that of the voltage applied from the charger 51 to electrically separate the paper sheet M from the rotary drum 10. This is especially effective in a case where the paper sheet M is held by electrostatic attraction.

An ink-jet printer according to a fourth embodiment of the present invention will be described with reference to FIGS. 16 to 19.

In the ink-jet printer of the first embodiment, the rotary drum 10 rotates at high speed during printing in the housing 1. Even when supply of electric power to the main motor 93 has been interrupted, the rotary drum 10 continues its rotation for a while because of inertia. In this condition, it is difficult to perform the jam state work or the maintenance work. The operator may be injured if he or she touches the rotary drum 10 by hand. The ink-jet printer of the fourth embodiment is used to solve the problem.

Figure 16:
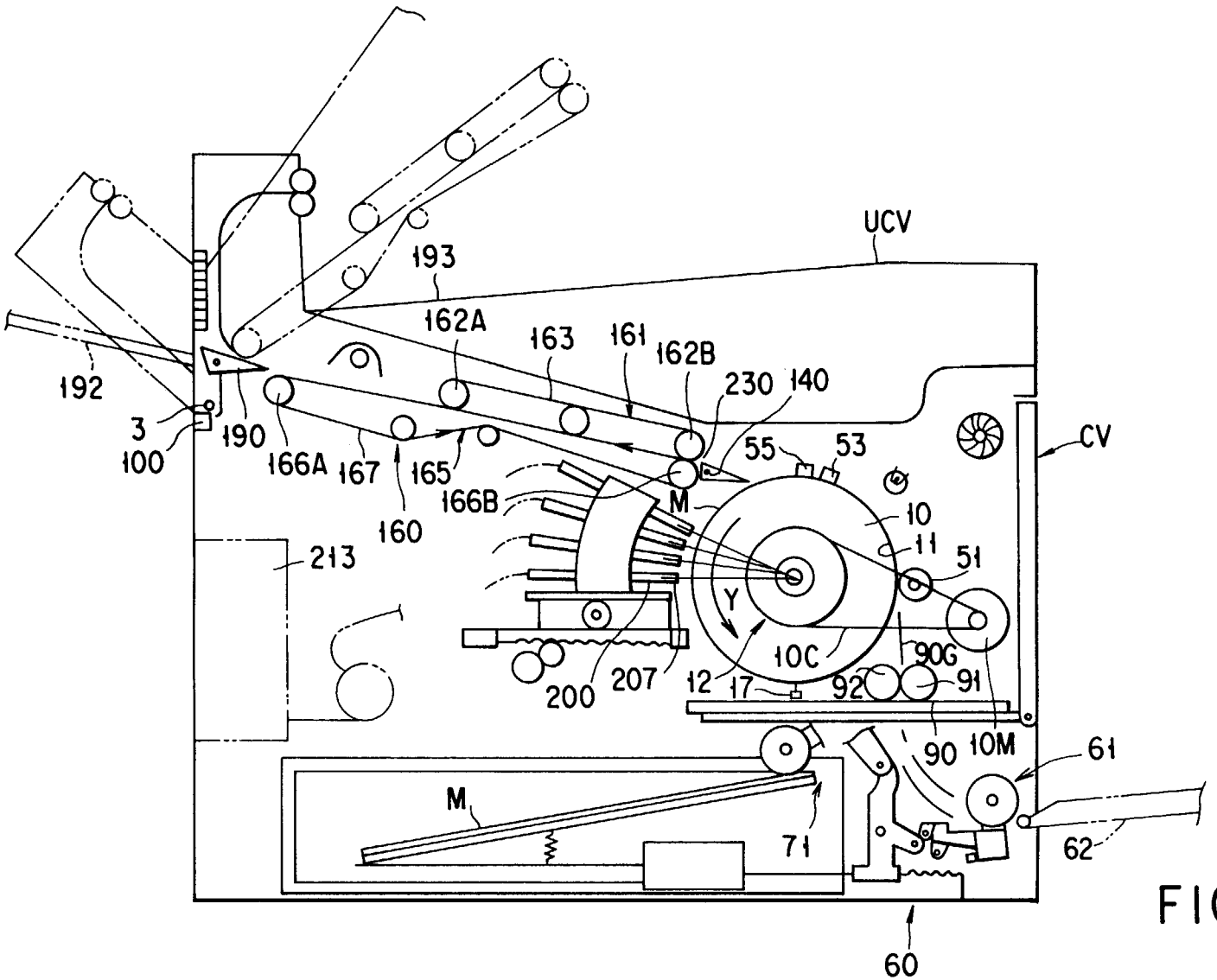
FIG. 16 is a sectional view showing the internal structure of an ink-jet printer according to a fourth embodiment of the present invention.

FIG. 16 shows the structure of this ink-jet printer. This ink-jet printer is substantially similar to that of the first embodiment except for the matters described below. Therefore, components similar to those in the first embodiment are denoted by the same reference numerals, and explanations thereof are omitted.

The ink-jet printer includes an upper cover UCV which can be switched between an open state and a closed state. The state of the upper cover UCV is detected by a cover open/closure detecting section 100 disposed near a spindle 3 of the upper cover UCV. The sheet feed-out mechanism 160 is constituted by an upper belt conveyer 161 and a lower belt conveyer 165. The upper belt conveyer 161 has upper rollers 162A and 162B spaced from each other in the sheet feeding direction, an upper belt 163 extending between the upper rollers 162A and 162B, and a driving section (not shown) for driving the upper belt 163. The lower belt conveyer 165 has lower rollers 166A and 166B spaced from each other in the sheet feeding direction, a lower belt 167 extending between the lower rollers 166A and 166B, and a driving section (not shown) for driving the lower belt 167. The belt conveyers 161 and 165 serves as a open mechanism which can rotate when the upper cover UCV is opened.

For example, when a jam of the paper sheet M has occurred between the upper and lower belt conveyers 161 and 165, the paper sheet M can easily be removed by rotating the upper belt conveyer 161 upward in FIG. 16.

Moreover, when a jam of the paper sheet M has occurred between the print head 200 and the rotary drum 10, the sheet M can easily be removed by rotating both the upper and lower belt conveyers 161 and 165 upward.

Figure 17:
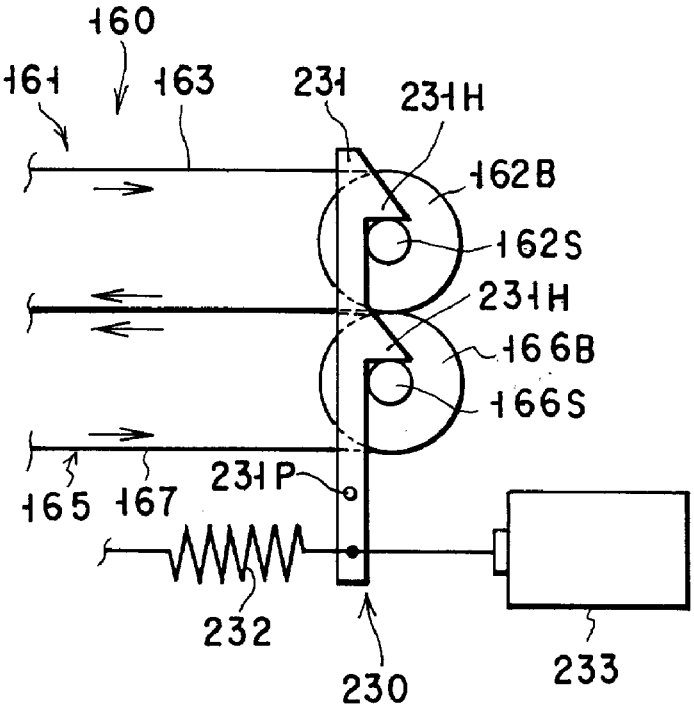
FIG. 17 is a view showing in detail a lock mechanism shown in FIG. 16.

A lock mechanism 230 is provided in the vicinity of rollers 162B and 166B. As is shown in FIG. 17, the lock mechanism 230 includes a lock lever 231, an urging spring 232 and a solenoid 233, and arranged to limit the rotation of the belt conveyers 161 and 165.

The lock lever 231 is pivotal about a spindle 231P, and has hooks 231H to be engaged with roller shafts 162S and 166S of the belt conveyers 161 and 165. The urging spring 232 urges the lock lever 231 clockwise in FIG. 17 to keep the engagement of the hooks 231H with the roller shafts 162S and 166S by an elastic force. The solenoid 233 rotates the lock lever 231 counter-clockwise in FIG. 17 against the elastic force of the urging spring 232, to thereby release the engagement of the hooks 231H with the roller shafts 162S and 166S.

When the solenoid 233 has been thus driven, the engagement of the lock lever 231 with the belt conveyers 161 and 165 is released, thereby upwardly rotating the belt conveyers 161 and 165, individually, into their released state. In other words, release of the belt conveyers 161 and 165 is enabled by driving the solenoid 233.

The control unit 111 outputs a stop signal for stopping the driving of the rotary drum 10 when it is detected by the cover opening/closure detecting section 100 that the upper cover UCV is opened, and causes the lock mechanism 230 to release its lock function after a preset period has elapsed from the timing of outputting the stop signal.

The control unit 111 includes a CPU, a ROM, a RAM, etc., and is connected to the print head 200, the cover open/closure detecting section 100, a timer 245, the solenoid 233 of the lock mechanism 230, etc.

Figure 19:
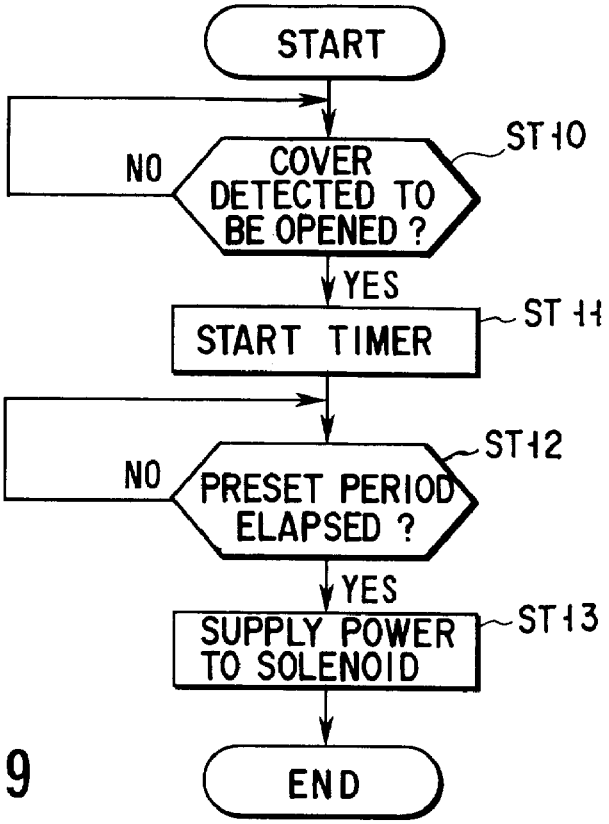
FIG. 19 is a flowchart for explaining a control operation of the control unit shown in FIG. 18.

The operation of the ink-jet printer will be described with reference to FIG. 19.

The user opens the upper cover UCV to carry out a jam state work or a maintenance work. When it is detected in step ST10 by the cover open/closure detecting section that the upper cover UCV is opened, the control unit 111 outputs a stop signal for stopping the driving of the rotary drum 10 and starts the timer 245 in step ST11. At this time, the lock lever 231 of the lock mechanism 230 has been engaged with the belt conveyers 161 and 165. Therefore, the conveyers 161 and 165 cannot be rotated and released.

Subsequently, if it is determined from the timer 245 in step ST12 that a preset period of time necessary for the complete stop of the rotary drum 10 has elapsed after the output of the stop signal, the control unit 111 supplies an electric power to the solenoid 233 in step ST13. As a result, the lock lever 231 rotates counterclockwise against the elastic force of the urging spring 232, thereby releasing the engagement of the belt conveyers 161 and 165. Thus, the release of the belt conveyers 161 and 165 is enabled.

Since the rotation of the rotary drum 10 has been completely stopped when the release of the belt conveyers 161 and 165 is enabled, the jam state work or maintenance work can be carried out safely and easily.

In the above embodiment, the control unit 111 controls the lock mechanism 230 such that lock releasing operation is performed to release the belt conveyers 161 and 165, when a preset period of time has elapsed after the opening of the upper cover UCV is detected by the cover open/closure detecting section 100. The rotation of the rotary drum 10 completely stops before the belt conveyers 161 and 165 are released, and hence the jam state work or maintenance work can be carried out safely and easily.

Figure 18:
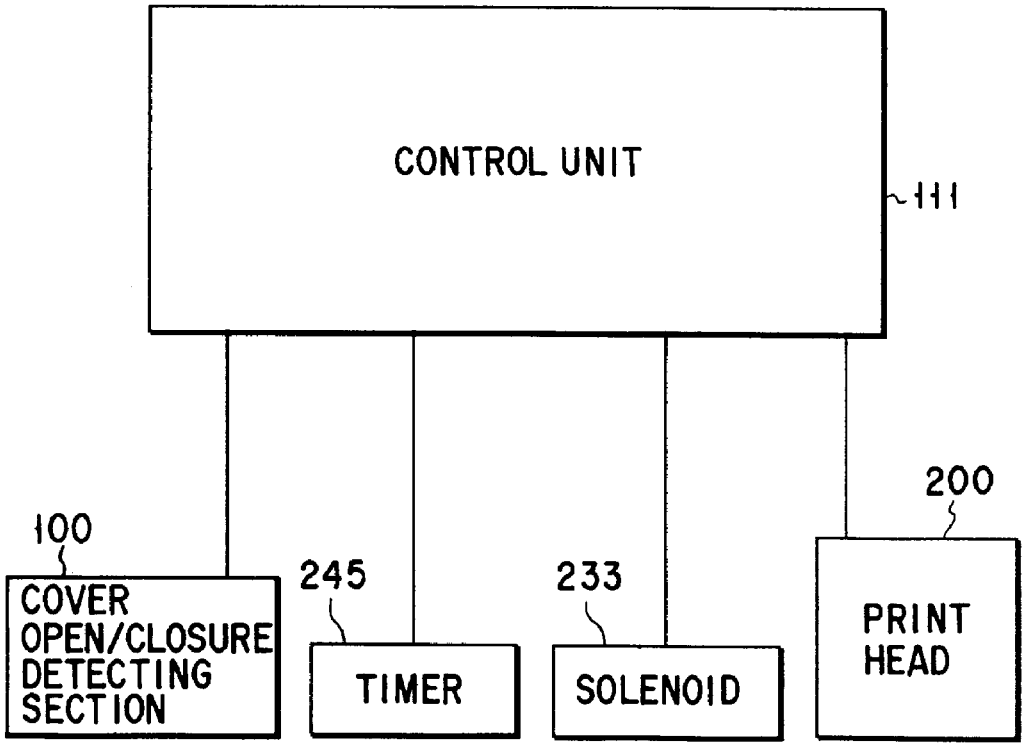
FIG. 18 is a view for briefly explaining a control unit incorporated in the ink-jet printer shown in FIG. 16.
Figure 20:
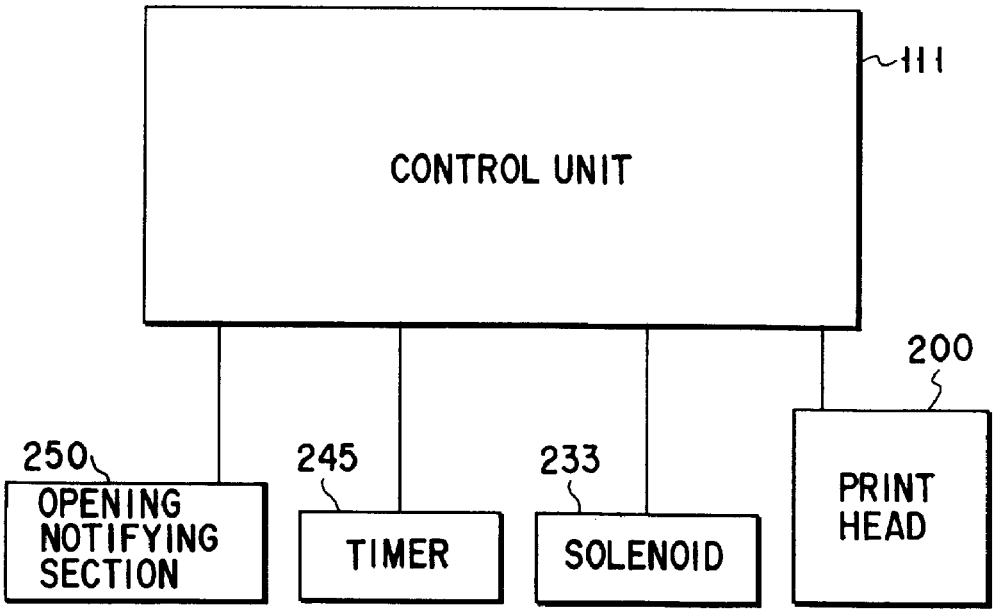
FIG. 20 is a view showing a modification of the control unit shown in FIG. 18.

FIG. 20 shows a modification of the control unit 111 shown in FIG. 18. In this modification, components similar to those employed in the above-described control unit 111 are denoted by the same reference numerals, and hence explanations thereof are simplified or omitted.

In the modification, the control unit 111 is connected to an opening notifying section 250 instead of the cover open/closure detecting section 100, and constructed such that the belt conveyers 161 and 165 are released upon elapse of a preset period after the cover opening is notified by the opening notifying section 250. The opening notifying section 250 is made up of, for example, a special key selected from various keys. When the operation of the special key has been detected, the control unit 111 outputs a stop signal for completely stopping the driving of the rotary drum 10, and causes the lock mechanism 230 to execute its lock releasing function when a preset period of time necessary for completely stopping the rotary drum 10 has elapsed after the output of the stop signal.

The user cannot release the belt conveyers 161 and 165 until the preset period elapses after the key operation. During the period which the cover is inhibited from being opened, the rotation of the rotary drum 10 completely stops. Accordingly, the jam state work or maintenance work can be safely and easily carried out.

In addition, the control unit 111 can be connected to an indicator such as a lamp which is lit to inform the user that a preset period has elapsed after the start of the timer 245. Further, the indicator may be modified such that the passing of time is informed by colored lamps which are selectively lit in an order of red, orange and blue, for example. By virtue of the above, the user can exactly confirm a required wait.

Figure 21:
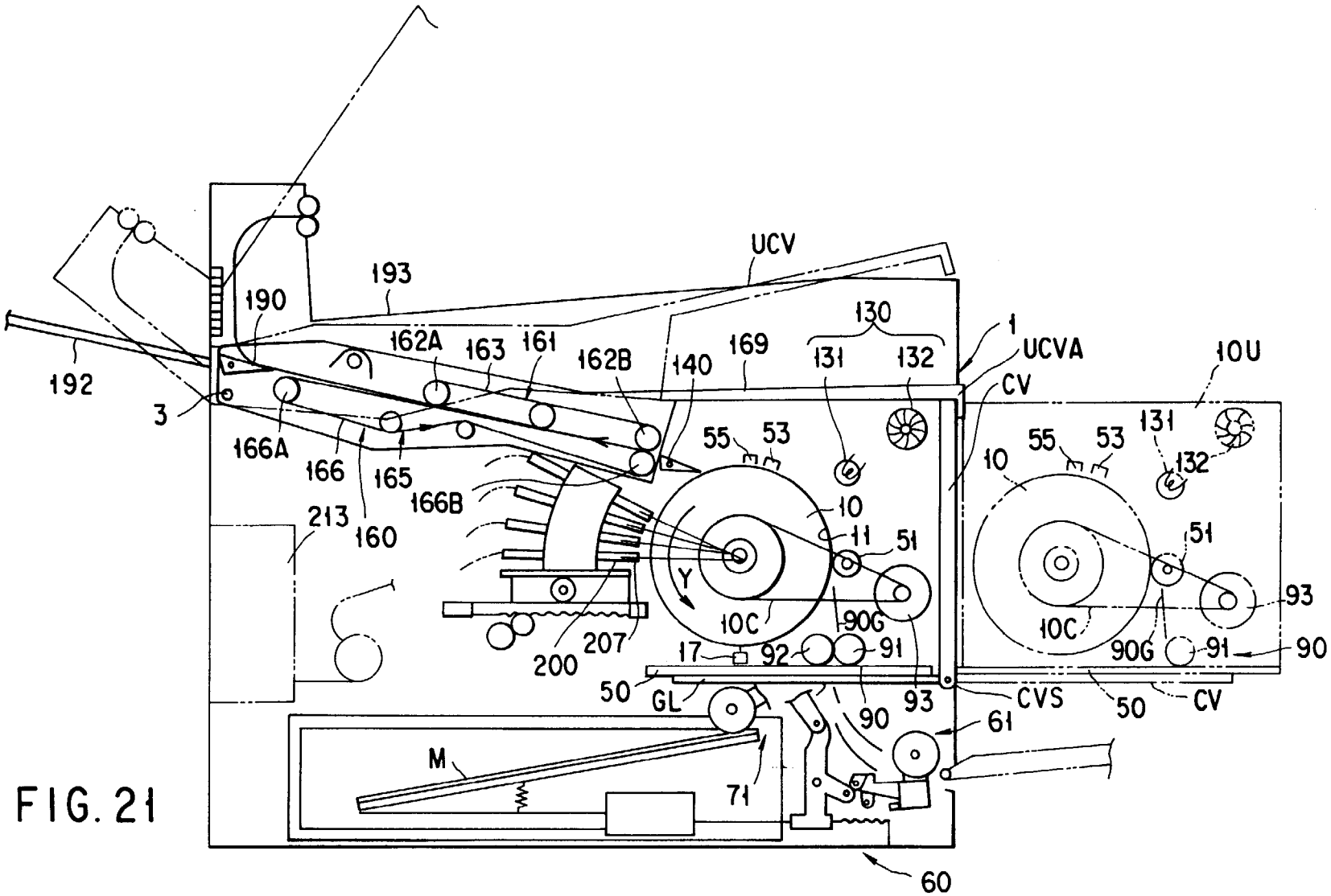
FIG. 21 is a view, showing a modification of neighboring components disposed around a rotary drum shown in FIG. 18.

FIG. 21 shows a modification of neighboring components disposed around a rotary drum shown in FIG. 18.

In this modification, the rotary drum 10 and the neighboring components serves as a rotary drum unit 10U which can be pulled out of the housing 1 when the side cover of the housing 1 is open.

Components similar to those employed in the first embodiment are denoted by the same reference numerals, and hence explanations thereof are simplified or omitted.

The rotary drum unit 10U includes the rotary drum 10, the main motor 93, the timing belt 10C, the charger 51, the supplementary charger 53, the discharger 55, the loading roller 91, the feed guide G, the heater 131 and the fan 132. These components are supported by the movable table TB, and the table TB can be pulled out of the housing 1 along the guide rail GL as indicated by the two-dot chain lines, when the side cover CV is open.

The side cover CV is attached to a side portion of the housing 1 via spindle CVS and capable of being opened and closed. The side cover CV has a free end to be engaged with an end portion UCVA of the upper cover UCV.

Since in the above structure, the side cover CV is engaged with the end portion UCVA of the upper cover UCV, the side cover CV cannot be opened until the release of the belt conveyers 161 and 165 is enabled, i.e. until a preset period has elapsed from the time when the upper cover UCV is opened.

As described above, not only the above space but also the side space of the housing are available to carry out the jam state work or maintenance work, and further the rotary drum unit 10U can be pulled out of the housing 1. The jam state work or maintenance work can be more facilitated.

In addition, such work can be more safely carried out since the rotary drum 10 has been completely stopped when the user opens the side cover CV or pulls the rotary drum unit 10U.

Although in the above modification, the side cover CV is engaged with the end portion UCVA of the upper cover UCV, the invention may be modified to have a structure in which opining of the side cover CV is directly enabled after a preset period has elapsed from the time when the upper cover UCV is opened or notification is obtained by the open notifying section 250.

According to the above described invention, in an ink-jet printer for ejecting ink onto a sheet of paper held on a rotary drum to perform printing, the printing speed can be improved without deteriorating the printing quality.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet printer comprising:

a rotary drum which is rotatable at a constant speed, said rotary drum having a peripheral surface for winding up a print medium;

medium loading means disposed near said rotary drum for loading the print medium on the peripheral surface of said rotary drum;

an ink-jet print head disposed to face the peripheral surface of said rotary drum for printing an image by repeatedly ejecting ink onto the print medium on the peripheral surface of said rotary drum while the print medium is moved relative to said ink-jet print head by rotation of said rotary drum;

medium removing means disposed near said rotary drum for removing the print medium on which the image has been printed by said ink-jet print head; and control means for sequentially driving said medium loading means, said ink-jet print head and said medium removing means during a predetermined number of rotations of said rotary drum in a manner such that an initial complete rotation is assigned to loading of the print medium by said medium loading means without printing, a last complete rotation is assigned to removing of the print medium by said medium removing means without printing, and a remainder of the rotations is assigned to printing of the image by said ink-jet print head wherein said initial complete rotation and said last complete rotation are always performed so as to reduce positional deviation or vibration of the print medium.

2. An ink-jet printer according to claim 1, wherein said medium loading means comprises:

means for feeding the print medium to the rotary drum; and means for causing the print medium fed by said medium feed-in mechanism to be held on the peripheral surface of said rotary drum.

3. An ink-jet printer according to claim 1, wherein said medium removing means comprises:

means for separating the print medium from the peripheral surface of said rotary drum; and means for feeding out the separated print medium.

4. An ink-jet printer according to claim 3, wherein said means for separating the print medium from the peripheral surface of said rotary drum comprises a separating member which is disposed at a position at which a leading end of the print medium is positioned when said print head has completed printing of the image on the print medium.

5. An ink-jet printer according to claim 4, wherein the means for separating the print medium from the peripheral surface of said rotary drum further comprises means for displacing said separating member along the peripheral surface of said rotary drum when the print medium has a length which is different than that of a preceding print medium.

6. An ink-jet printer according to claim 4, wherein the means for separating the print medium from the peripheral surface of said rotary drum further comprises at least one additional separating member disposed along the peripheral surface of said rotary drum.

7. An ink-jet printer according to claim 1, further comprising:

a housing which houses said medium loading means, said rotary drum, said print head, said medium removing means and said control means; and a movable table which is movable into and out of said housing together with components of at least said rotary drum and said medium loading means in a state where the components are mounted on said movable table.

8. An ink-jet printer according to claim 1, further comprising:

a housing which houses said medium loading means, said rotary drum, said print head, said medium removing means, and said control means;

means for opening the housing; and means for preventing opening of the housing during rotation of said rotary drum.

9. An ink-jet printer according to claim 8, wherein said control means includes:

means for issuing an opening instruction signal to initiate opening of the housing; and means for outputting a stop signal to stop driving of said rotary drum upon issuance of the opening instruction signal, and for enabling opening of the housing after a preset period of time has elapsed from the output of the stop signal.

10. An ink-jet printer according to claim 9, further comprising an openable and closable cover attached to the housing, and a detector for detecting opening of said cover and for causing the opening instruction signal to be issued responsive thereto.

* * * * *